US009481167B2

(12) United States Patent
Togashi

(10) Patent No.: US 9,481,167 B2
(45) Date of Patent: Nov. 1, 2016

(54) LIQUID EJECTING HEAD AND LIQUID EJECTING APPARATUS

(71) Applicant: Seiko Epson Corporation, Tokyo (JP)

(72) Inventor: Isamu Togashi, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/272,815

(22) Filed: May 8, 2014

(65) Prior Publication Data

US 2015/0042727 A1 Feb. 12, 2015

Related U.S. Application Data

(60) Provisional application No. 61/863,551, filed on Aug. 8, 2013.

(51) Int. Cl.
*B41J 2/045* (2006.01)
*B41J 2/14* (2006.01)

(52) U.S. Cl.
CPC ..... *B41J 2/04581* (2013.01); *B41J 2/04588* (2013.01); *B41J 2/14274* (2013.01)

(58) Field of Classification Search
None
See application file for complete search history.

(56) References Cited

U.S. PATENT DOCUMENTS

| | | | | |
|---|---|---|---|---|
| 5,424,769 | A | 6/1995 | Sakai et al. | |
| 2002/0017142 | A1* | 2/2002 | Kitahara | 73/662 |
| 2009/0244128 | A1 | 10/2009 | Ozawa et al. | |
| 2012/0081468 | A1 | 4/2012 | Ozawa et al. | |

FOREIGN PATENT DOCUMENTS

| | | | |
|---|---|---|---|
| CN | 101544110 | A | 9/2009 |
| JP | 06-320725 | | 11/1994 |
| JP | 2001-347660 | A | 12/2001 |

* cited by examiner

*Primary Examiner* — Erica Lin
(74) *Attorney, Agent, or Firm* — Harness, Dickey & Pierce, P.L.C.

(57) ABSTRACT

In a liquid ejecting head, a vibration plate includes an effective displacement portion provided for each pressure chamber and an island-shaped part which is provided in the effective displacement portion at a position on the opposite side to the pressure chamber and to which one end portion of a piezoelectric vibrator is bonded; the piezoelectric vibrator has a laminate structure in which electrodes and piezoelectric material are alternately laminated; a layer at an end of one side of the piezoelectric vibrator in the laminating direction is formed of an external electrode, while a layer at an end of the other side thereof in the same direction is formed of a piezoelectric material; and the piezoelectric vibrator is disposed so as to be shifted toward the other side in the laminating direction with respect to the effective displacement portion.

16 Claims, 9 Drawing Sheets

LIQUID EJECTING HEAD AND LIQUID EJECTING APPARATUS

RELATED APPLICATION

This application claims the benefit of U.S. Provisional Application No. 61/863,551 filed on Aug. 8, 2013. The entire disclosure of the above application is incorporated herein by reference.

BACKGROUND

1. Technical Field

The present invention relates to liquid ejecting heads such as ink jet recording heads and liquid ejecting apparatuses, and particularly relates to liquid ejecting heads that eject liquid through a nozzle by displacing a diaphragm portion defining part of a pressure chamber using a piezoelectric element, and liquid ejecting apparatuses.

2. Related Art

Liquid ejecting apparatuses are apparatuses that include a liquid ejecting head capable of ejecting liquid as a liquid droplet and eject various kinds of liquids from the liquid ejecting head. As a representative example of liquid ejecting apparatuses, an image recording apparatus such as an ink jet recording apparatus (printer) that includes an ink jet recording head (hereinafter, referred to as a "recording head"), for example, and performs recording (printing) by ejecting liquid ink as an ink droplet from the recording head, can be cited. In recent years, liquid ejecting apparatuses have been applied to, in addition to the above-mentioned image recording apparatus, various kinds of manufacturing apparatuses such as display manufacturing apparatuses and the like.

Some existing ink jet recording heads (hereinafter, simply called "recording heads") have a configuration in which a vibrator unit that includes a plurality of piezoelectric vibrators bonded to a fixing plate, a resin case in which an accommodation space capable of accommodating the vibrator unit is formed, and a flow path unit that is bonded to a leading end portion of the resin case (for example, see JP-A-2001-347660 or JP-A-6-320725) are provided. A vibration plate that defines part of a pressure chamber within the flow path unit is displaced by the piezoelectric vibrator so as to change a volume of the pressure chamber, thereby causing a pressure change in the pressure chamber so that the ink is discharged through a nozzle.

The above-mentioned piezoelectric vibrator is formed by laminating a plurality of members. Each member has electrodes formed on a piezoelectric layer. The electrodes formed between the piezoelectric layers function as internal electrodes (individual internal electrodes, common internal electrodes). External electrodes (individual external electrodes, common external electrodes) connected with the internal electrodes are formed on the outer surfaces of the piezoelectric vibrator by sputtering or the like. When driving signals from a printer main body are applied to the external electrodes via a wiring member, electric fields are supplied to the piezoelectric layers (active portions) sandwiched between the two internal electrodes or between the external and internal electrodes so that the piezoelectric layers are deformed. As a result, the piezoelectric vibrator expands or contracts.

The vibration plate has a diaphragm portion configured of a flexible film for sealing an opening surface of the pressure chamber and an island provided on the flexible film. The island is a portion to which a leading end portion of the piezoelectric vibrator is bonded, and is generally made of a metallic block substantially formed in a rectangular parallelepiped shape. The flexible film circumferentially surrounding the island functions as an elastic film portion. When the piezoelectric vibrator is displaced to contract or expand, the island is displaced, whereby a volume of the pressure chamber is changed. The change in the volume of the pressure chamber causes a change in the pressure applied to the ink within the pressure chamber and, making use of this pressure change, the recording head ejects the ink through the nozzle. In JP-A-2001-347660, a problem is described that a fixing plate which is bonded to a base end portion on one side surface in a laminating direction of the piezoelectric layers and electrodes limits the displacement of the piezoelectric vibrator. More specifically, a portion of the piezoelectric vibrator that is on the opposite side to the fixing plate in the laminating direction has a larger displacement than the portion on the fixing plate side (especially, changes largely at a time of contraction). Accordingly, in JP-A-2001-347660, in order to suppress the above problem from occurring, a configuration in which an amount of displacement is suppressed at a portion on the opposite side to the fixing plate is disclosed. Further, in JP-A-6-320725, a configuration is disclosed with which fatigue fracture of an elastic film (thin portion) and cavitation, caused by driving of a piezoelectric vibrator bonded to an island of a vibration plate, are suppressed.

These piezoelectric vibrators respectively have external electrodes formed on both side surfaces thereof in the laminating direction of the piezoelectric layers and electrodes. In these respective piezoelectric vibrators, the thickness of the piezoelectric layers positioned on both sides of the piezoelectric vibrator in the laminating direction of the piezoelectric layers and electrodes varies largely depending on each individual piezoelectric vibrator in comparison with the thickness of the piezoelectric layers positioned between both sides in the laminating direction. Further, the thickness also varies largely between one end side and the other end side of the piezoelectric vibrator in the identical piezoelectric vibrator. The variation in the thickness causes a variation in the active displacement of the corresponding portions of the piezoelectric vibrator, which in turn unfavorably influences an ink discharge characteristic.

Accordingly, there is a piezoelectric vibrator without external electrodes formed on both side surfaces in the laminating direction. In this piezoelectric vibrator, since piezoelectric layers positioned on both sides in the laminating direction are not supplied with electric fields so that the corresponding portions are not actively displaced, the variation in thickness is unlikely to cause a variation in the displacement of the corresponding portions, which in turn reduces the influence upon the ink discharge characteristic. However, since the number of inactive portions which are not actively displaced, has increased, the displacement amount of the piezoelectric vibrator decreases as a whole.

The above problem occurs not only in an ink jet recording apparatus equipped with an ink jet recording head for discharging ink, but also in a liquid ejecting apparatus equipped with a different liquid ejecting head for ejecting a liquid other than ink.

SUMMARY

An advantage of some aspects of the invention is to provide a liquid ejecting head capable of enhancing an amount of displacement of a piezoelectric vibrator and enhancing a discharge characteristic using the piezoelectric vibrator, and a liquid ejecting apparatus.

A liquid ejecting head according to an embodiment of the present invention is proposed to achieve the above object and includes a pressure chamber communicating with a nozzle, a vibration plate defining part of the pressure chamber, and a piezoelectric vibrator configured to displace the vibration plate. In the liquid ejecting head, the vibration plate includes an effective displacement portion which is a region displaced in accordance with displacement of the piezoelectric vibrator and is provided for each pressure chamber, the piezoelectric vibrator has a laminate structure in which electrodes and piezoelectric material are alternately laminated, a layer at an end of one side (hereinafter referred to as a first side) of the laminate structure in a laminating direction is an electrode while a layer at an end of the other side (hereinafter referred to as a second side) of the laminate structure in the same direction is a piezoelectric member, and the piezoelectric vibrator is disposed so as to be shifted toward the second side in the laminating direction with respect to the effective displacement portion.

By employing the configuration in which an electrode is formed on a layer at the end of the first side of the laminate structure in the laminating direction while no electrode is formed on a layer at the end of the second side thereof in the laminating direction, it is possible to make the displacement amount of the layer at the end of the first side be large and also make the displacement amount be larger for sure than the displacement amount of the layer at the end of the second side. In comparison with a case in which electrodes are formed on layers on both ends of the first and second sides, a magnitude relationship of the displacement amounts from the layer at the end of the second side toward the layer at the end of the first side, that is, a magnitude relationship that the displacement amount becomes larger as it progresses from the layer at the end of the second side toward the layer at the end of the first side, is always maintained between individual piezoelectric vibrators and also between the ends of the first side and the second side of the identical piezoelectric vibrator. Further, because the piezoelectric vibrator is disposed so as to be shifted toward the second side in the laminating direction with respect to the effective displacement portion, it is possible to displace the regions on both sides from the center of the effective displacement portion in the laminating direction as equally as possible when the piezoelectric vibrator is driven. As a result, the displacement of the piezoelectric vibrator at the time of being driven can be further effectively converted to a pressure change. Furthermore, since the volume of the pressure chamber can be changed efficiently and stably by driving the piezoelectric vibrator, it is possible to reduce problems such as variation in a liquid amount ejected through the nozzle, variation in the flying direction of the liquid, and the like caused by deflection in the displacement of the piezoelectric vibrator.

It is preferable in the above configuration that the vibration plate include an island-shaped part which is provided at a position on the opposite side to the pressure chamber sandwiching the effective displacement portion therebetween and to which one end portion of the piezoelectric vibrator is bonded, that the island-shaped part be provided at a center portion of the effective displacement portion in the laminating direction, and that a configuration be employed in which the length of an extending portion of the island-shaped part extended to both first and second sides in the laminating direction from a bonding portion of the island-shaped part and the piezoelectric vibrator is longer at the first side than at the second side.

It is preferable in this configuration that a configuration be employed in which the width of the extending portion of the island-shaped part on the second side in a direction intersecting with the laminating direction is wider than that of other portions.

According to the above configuration, a portion on the first side of the piezoelectric vibrator whose displacement amount is relatively large is disposed on a portion of the island-shaped part whose width is relatively small, while a portion on the second side of the piezoelectric vibrator whose displacement amount is relatively small is disposed on a portion of the island-shaped part whose width is relatively wide. Further, in a wide-width portion where the width of the island-shaped part is wider, a larger area range of the effective displacement portion is displaced in comparison with a case of a narrow-width portion where the width of the island-shaped part is narrower. Accordingly, it is possible to make the displacement amounts of the regions on both sides from the center of the effective displacement portion in the laminating direction be further matched when the piezoelectric vibrator is driven. As a result, the volume of the pressure chamber can be further effectively and stably changed.

It is preferable in the above configuration that a ratio of the dimension of the island-shaped part to the dimension of the effective displacement portion in the laminating direction is equal to or more than 0.85.

According to this configuration, it is possible to efficiently convert the displacement of the piezoelectric vibrator to a change in volume of the pressure chamber.

Further, in the above configuration, it is possible to employ a configuration in which a fixing plate is bonded to the other side surface of the piezoelectric vibrator at a position being shifted up to a side which is opposite to a bonding side where the island-shaped part is bonded with the piezoelectric vibrator.

A liquid ejecting head according to an embodiment of the present invention includes a pressure chamber communicating with a nozzle, a vibration plate defining part of the pressure chamber, and a piezoelectric vibrator configured to displace the vibration plate. In the liquid ejecting head, the vibration plate includes an effective displacement portion which is a region displaced in accordance with displacement of the piezoelectric vibrator and is provided for each pressure chamber and also includes an island-shaped part which is provided at a position on the opposite side to the pressure chamber sandwiching the effective displacement portion therebetween and to which one end portion of the piezoelectric vibrator is bonded, the piezoelectric vibrator has a laminate structure in which electrodes and piezoelectric material are alternately laminated, a layer at an end of one side (hereinafter referred to as a third side) of the piezoelectric vibrator in the laminating direction is an electrode while a layer at an end of the other side (hereinafter referred to as a fourth side) of the piezoelectric vibrator in the same direction is a piezoelectric member, and the island-shaped part is disposed so as to be shifted toward the fourth side in the laminating direction with respect to the effective displacement portion.

According to the above configuration, by employing the configuration in which an electrode is formed on the layer at the end of the third side of the laminate structure in the laminating direction while no electrode is formed on the layer at the end of the second side of the laminate structure in the same direction, it is possible to make the displacement amount of the layer at the end of the third side be large and also make the displacement amount be larger for sure than the displacement amount of the layer at the end of the fourth side. In comparison with a case in which electrodes are formed on layers at both ends of the third and fourth sides, a magnitude relationship of the displacement amounts from the layer at the end of the fourth side toward the layer at the end of the third side, that is, a magnitude relationship that the displacement amount becomes larger as it progresses from the layer at the end of the fourth side toward the layer at the end of the third side, is always maintained between individual piezoelectric vibrators and also between the ends of the third side and the fourth side of the identical piezoelectric vibrator. Further, because the island-shaped part is provided so as to be shifted toward the fourth side in the laminating direction with respect to the effective displacement portion, it is possible to displace the regions on both sides from the center of the effective displacement portion in the laminating direction as equally as possible via the island-shaped part when the piezoelectric vibrator is driven. As a result, the displacement of the piezoelectric vibrator at the time of being driven can be further effectively converted to a pressure change. Furthermore, since the volume of the pressure chamber can be changed efficiently and stably by driving the piezoelectric vibrator, it is possible to reduce problems such as variation in a liquid amount ejected through the nozzle, variation in the flying direction of the liquid, and the like caused by deflection in the displacement of the piezoelectric vibrator.

It is preferable in the above configuration that the piezoelectric vibrator be provided at a center portion of the effective displacement portion in the laminating direction, and a configuration be employed in which the length of an extending portion of the island-shaped part extended to both sides in the laminating direction from a bonding portion of the island-shaped part and the piezoelectric vibrator is longer at the fourth side than at the third side.

A liquid ejecting apparatus according to an embodiment of the present invention includes at least one of the liquid ejecting heads according to the above configurations.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, embodiments for implementing the present invention will be described with reference to the accompanying drawings. Although various features are placed in the embodiments described below as preferred examples of the present invention, the scope of the present invention is not limited thereto. Note that in the following embodiments, as a liquid ejecting apparatus of the present invention, an ink jet recording apparatus (hereinafter, called a "printer") equipped with an ink jet recording head (hereinafter, called a "recording head"), which is a type of a liquid ejecting head, is cited and explained.

Figure 1:
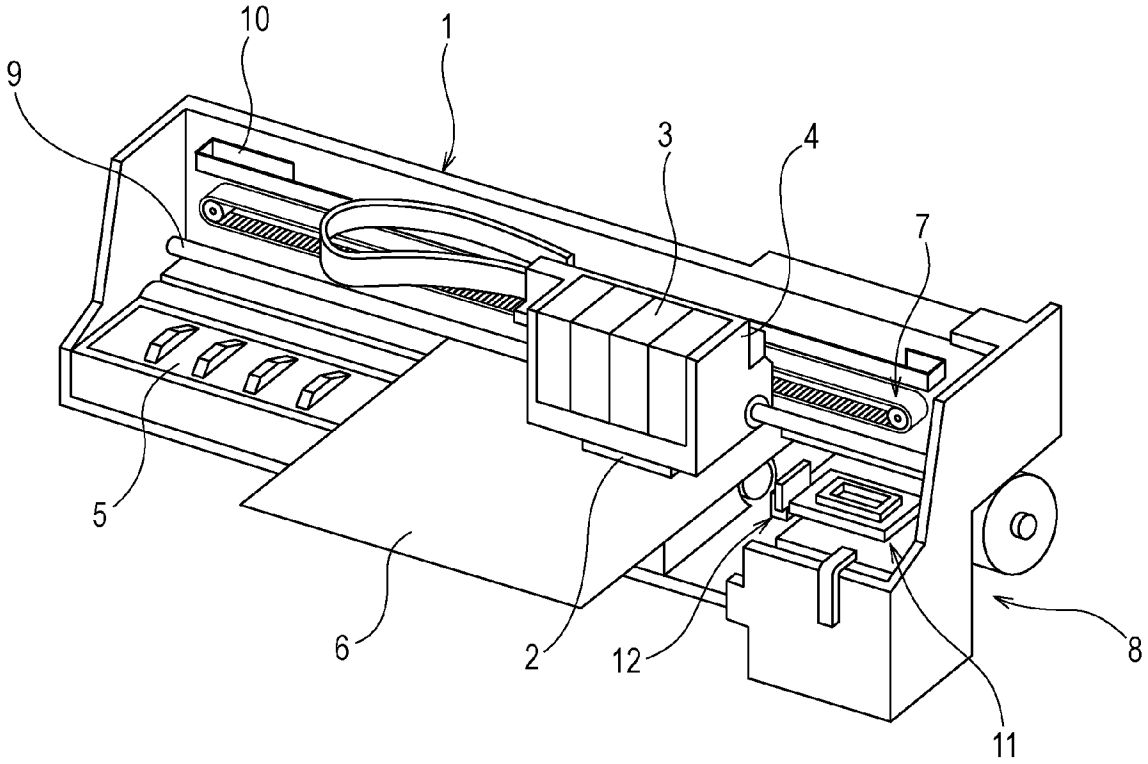
FIG. 1 is a schematic view of a printer.

FIG. 1 is a view illustrating a configuration of a printer 1. The printer 1 is generally configured of a carriage 4 on which a recording head 2 is mounted and an ink cartridge 3, which is a type of a liquid supply source, is also mounted in a detachable manner, a platen 5 disposed under the recording head 2 in recording operation, a carriage movement mechanism 7 configured to move the carriage 4 back and forth in a paper width direction of recording paper 6 (a type of a recording medium and a landing target), in other words, in a main scanning direction, and a paper transport mechanism 8 configured to transport the recording paper 6 in a sub scanning direction that is orthogonal to the main scanning direction.

The carriage 4 is attached in a movable manner to a guide rod 9 installed along the main scanning direction, and is configured so as to move in the main scanning direction along the guide rod 9 driven by of the carriage movement mechanism 7. The position of the carriage 4 in the main scanning direction is detected by a linear encoder 10, and a detection signal thereof, in other words, an encoder pulse (a type of positional information) is transmitted to a controller of the printer main body (not shown). The linear encoder 10 is a type of positional information outputting means, and outputs an encoder pulse EP in accordance with a scanning position of the recording head 2 as positional information in the scanning direction.

Within a movement range of the carriage 4, a home position as a base point for scanning operation of the carriage is provided in an end region at the outside of a recording region. At the home position in the present embodiment, there are disposed a capping member 11 for sealing a nozzle formation surface (nozzle plate 24: see, e.g., FIG. 2 and FIG. 4A) of the recording head 2 and a wiper member 12 for wiping the nozzle formation surface. The printer 1 is configured so as to perform what is called "bidirectional recording" in which characters, images, and the like are recorded on the recording paper 6 during the carriage 4 moving bi-directionally, that is, during the forward movement of the carriage 4 from the home position toward an end portion located on the opposite side and the backward movement from the end portion on the opposite side toward the home position.

Figure 2:
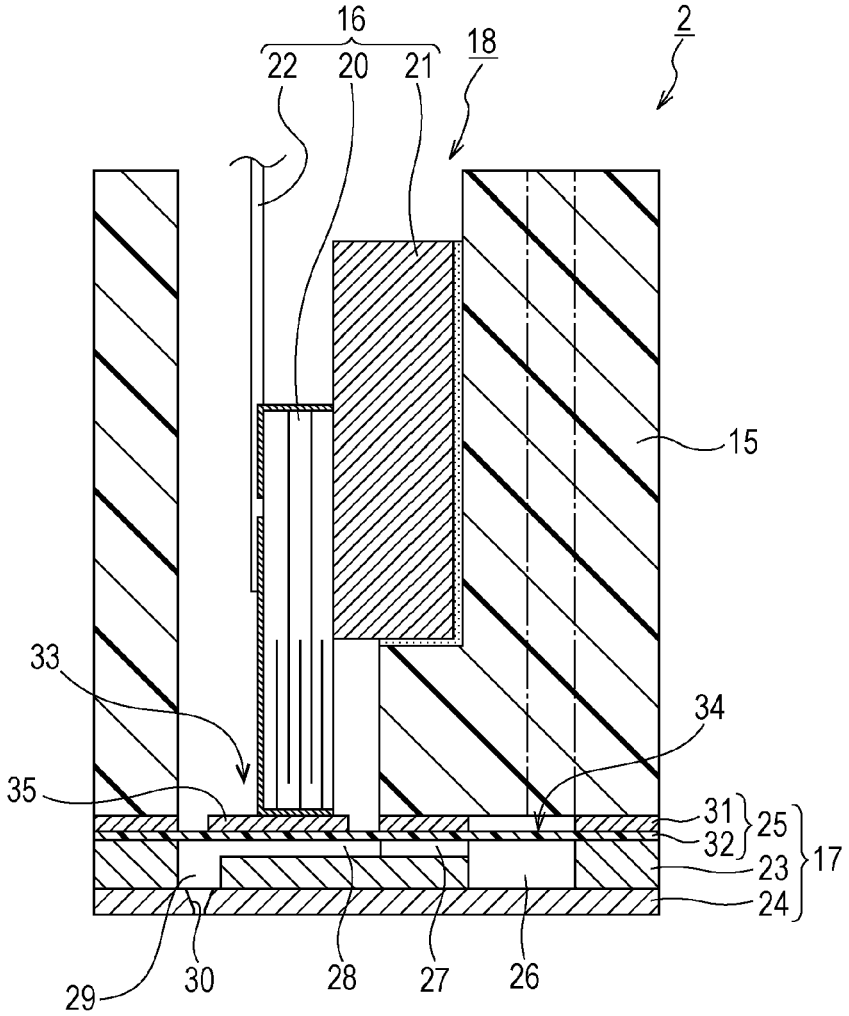
FIG. 2 is a cross-sectional view of a recording head.
Figure 3:
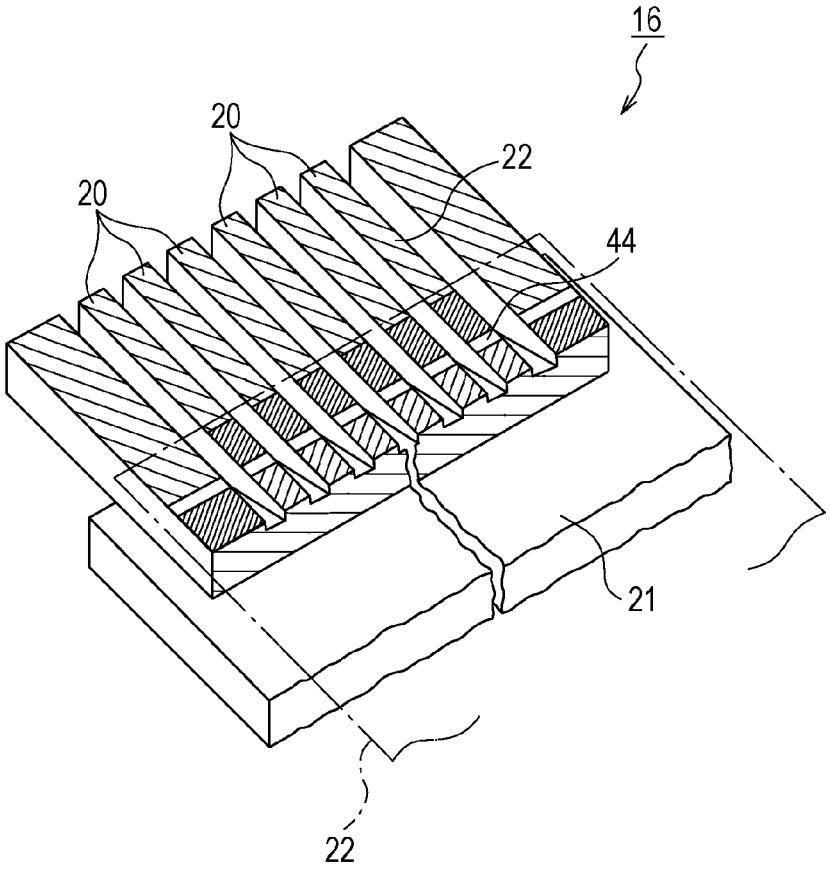
FIG. 3 is a perspective view of a vibrator unit.
Figure 4A:
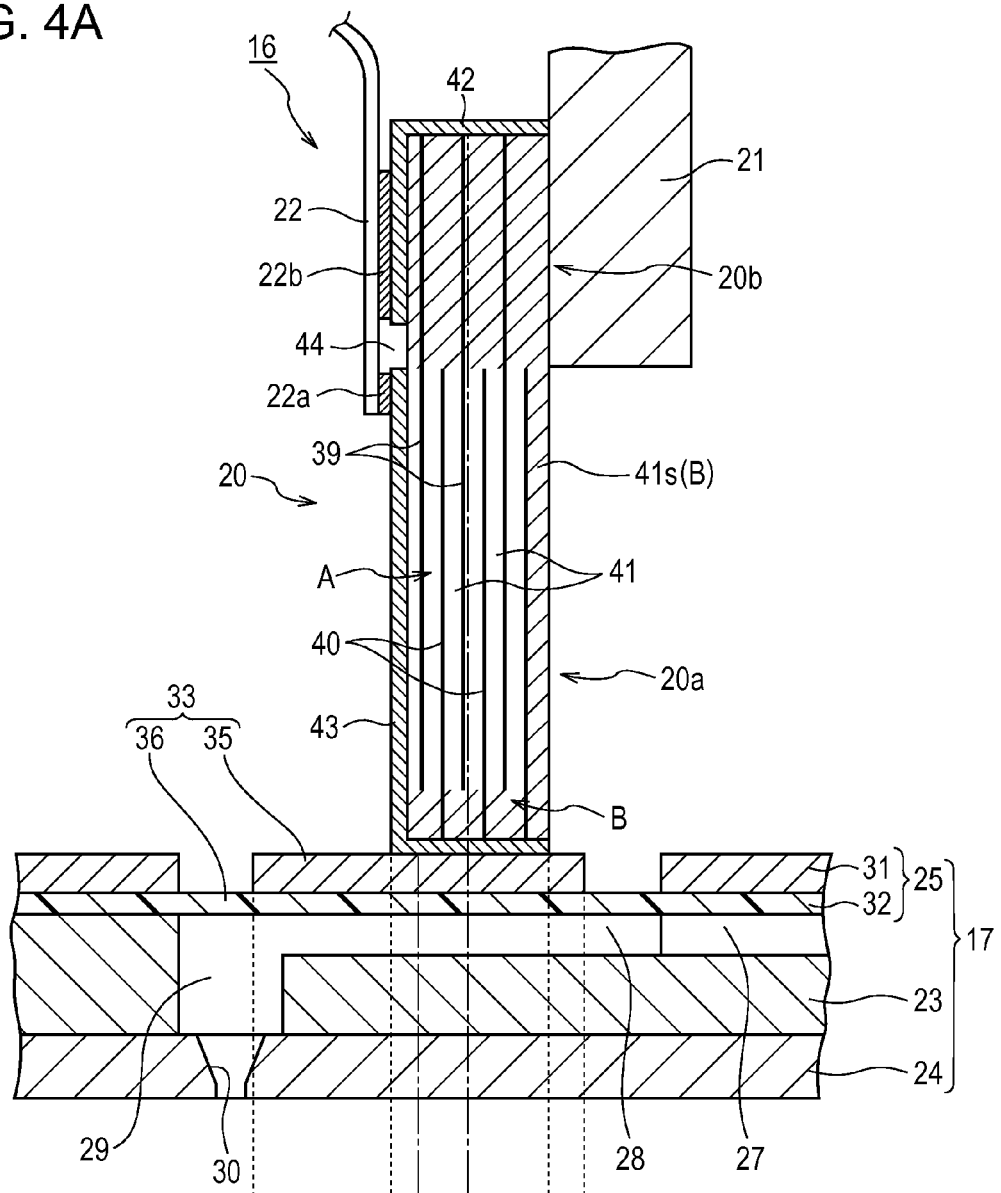
FIGS. 4A and 4B are views of the periphery of a vibrator unit.
Figure 4B:
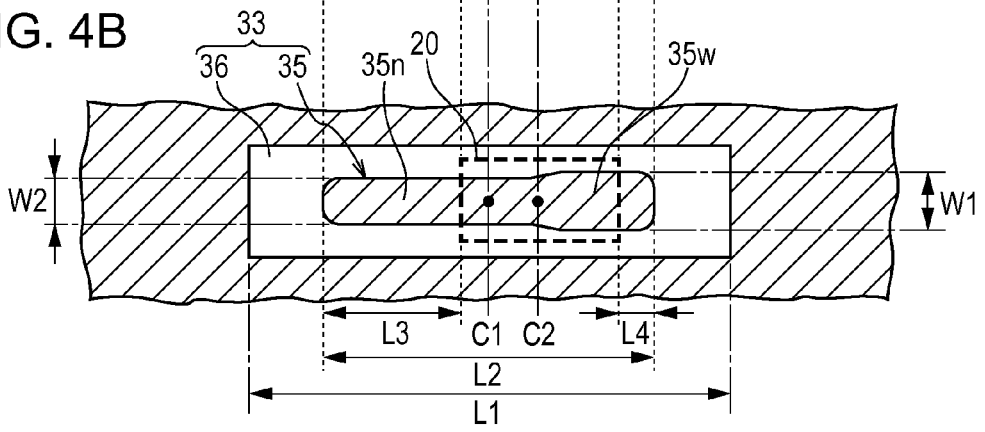

FIG. 2 is a cross-sectional view of the recording head 2. FIG. 3 is a perspective view of a vibrator unit 16. FIGS. 4A and 4B are views of the periphery of the vibrator unit 16. More specifically, FIG. 4A is a cross-sectional view of the vibrator unit 16 and a flow path unit 17, in which a case 15 is not illustrated. FIG. 4B is a plan view of a diaphragm portion 33 of a vibration plate 25 when viewed from above in the vertical direction (from the vibrator unit 16 side), and illustrates a configuration corresponding to one piezoelectric vibrator 20.

The recording head 2 in the present embodiment includes the case 15, the vibrator unit 16 accommodated in the case 15, and the flow path unit 17 bonded to a bottom surface (leading end surface) of the case 15. The case 15 is made of, for example, an epoxy-based resin, and an accommodation space 18 for accommodating the vibrator unit is formed inside the case 15. The vibrator unit 16 includes a plurality of piezoelectric vibrators 20, a metallic fixing plate 21 to which the piezoelectric vibrators 20 are bonded, and a flexible cable 22 configured to supply the piezoelectric vibrators 20 with driving signals and the like. The piezoelectric vibrator 20 is a laminate structure-type component in which piezoelectric material and electrodes are alternately laminated, and is a longitudinal vibration-mode piezoelectric vibrator (lateral field effect type) that is capable of expanding and contracting in a displacement amount defined by a piezoelectric constant D31 in a direction orthogonal to the laminating direction (electric filed direction).

The piezoelectric vibrator 20 is manufactured through the following processes: that is, a process in which internal electrode material (i.e., a common internal electrode 39 and an individual internal electrode 40) are formed (printed) on surfaces of each of piezoelectric material 41 made of zirconia, lead zirconate titanate, or the like to produce base members first, subsequently a plurality of base members are laminated so that the piezoelectric material 41, the electrodes (i.e., the common internal electrode 39 and the individual internal electrode 40) are disposed alternately in a layered manner; a process in which a piezoelectric plate of a laminate structure is baked; a process in which external electrodes (i.e., a common external electrode 42 and an individual external electrode 43) are formed on an outer surface of the baked piezoelectric plate by sputtering or the like; and a process in which the piezoelectric plate on which the external electrodes (i.e., the common external electrode 42 and the individual external electrode 43) are formed is cut and divided in a comb-toothed manner. Each comb tooth made by cutting and dividing the piezoelectric plate functions as part of the piezoelectric vibrator 20 corresponding to each pressure chamber 28. Note that, in the above manufacturing processes, a warp in the piezoelectric plate having been baked is ground to be flat by lapping processing. Since variation in amount of polishing is large in the lapping processing, it is necessary to take a large cutting amount on the outmost surface of the piezoelectric plate having been baked. Moreover, a variation in the thickness is also large after the lapping processing, in particular, a layer at a side end in the laminate structure is likely to vary in thickness. Accordingly, in a configuration in which electrodes are formed on layers on both side ends, because the electrodes on both sides vary in thickness, stable characteristics are unlikely to be obtained for the vibrator unit. There is a method such that the thicknesses of the respective layers of the piezoelectric material 41 are controlled to be as uniform as possible so as to suppress a warp in the piezoelectric plate having been baked as much as possible, thereby omitting the lapping processing. However, having experienced cleaning processing and cut-and-divide processing in the manufacturing processes, layers at the side ends in the laminate structure are likely to vary in thickness so as to unfavorably influence characteristics for the vibrator unit. These problems are solved in the vibrator unit 16 of the present embodiment, which will be described later.

The piezoelectric vibrator 20 of the present embodiment is formed by alternately laminating the common internal electrodes 39 and the individual internal electrodes 40 while sandwiching the piezoelectric material 41 therebetween. The common internal electrodes 39 are an electrode which is common to all the piezoelectric vibrators 20 and to which a ground potential or a bias potential is applied. The individual internal electrodes 40 are an electrode whose potential varies in accordance with an ejection driving pulse DP of a driving signal being applied thereto (see FIG. 5). In the present embodiment, from a vibrator leading end of the piezoelectric vibrator 20 (a side bonded to an island-shaped part 35), approximately two thirds of the length of the piezoelectric vibrator in a vibrator lengthwise direction (a direction orthogonal to the laminating direction) corresponds to a free end portion 20*a*. The remaining part of the piezoelectric vibrator 20, in other words, a portion from a base end of the free end portion 20*a* up to a vibrator base end corresponds to a base end portion 20*b*.

The individual external electrode 43 is formed continuously from a boundary between the free end portion 20*a* and the base end portion 20*b* on a wiring connection surface as one side surface in the laminating direction (surface on the left side in FIG. 4A) across a leading end surface of the free end portion 20*a*. The individual external electrode 43 is connected with the individual internal electrodes 40 at the leading end surface of the free end portion 20*a*. Further, an individual wiring electrode 22*a* of the flexible cable 22 is electrically connected to the individual external electrode 43. Accordingly, the individual external electrode 43 makes the individual wiring electrode 22*a* and the individual internal electrodes 40 be electrically connected with each other. The common external electrode 42 is an electrode which is formed continuously from the boundary between the free end portion 20*a* and the base end portion 20*b* on the wiring connection surface across a base end surface of the piezoelectric vibrator 20 which is on the opposite side to the leading end surface thereof, and is electrically connected with the common internal electrodes 39 at the base end surface. A common wiring electrode 22*b* of the flexible cable is electrically connected to the common external electrode 42. Accordingly, the common external electrode 42 makes the common wiring electrode 22*b* and the common internal electrodes 39 be electrically connected with each other.

The individual external electrode 43 and the common external electrode 42 on the wiring connection surface are cut off and electrically insulated from each other by a slit 44 (a portion where the electrode material is removed in a slit-like form) provided along an alignment direction of the piezoelectric vibrators 20. As described above, in the piezoelectric vibrator 20, a layer at an end of a surface of one side (hereinafter referred to as the first side) in the laminating direction includes the electrodes 42 and 43, whereas no electrode material is formed on a surface of the other side (hereinafter referred to as the second side), i.e., a bonding surface to which the fixing plate 21 is bonded, in the laminating direction and the piezoelectric material 41 (41*s*) is exposed as a layer at the end of the second side. The fixing plate 21 is bonded to this surface of the second side at the base end portion 20*b* side. Accordingly, the piezoelectric vibrator 20 is supported by the fixing plate 21 in what is called a cantilever manner. Protective films are formed on the surfaces of the layers on both the side ends in the laminating direction in some cases.

In the free end portion 20*a*, an active portion A is formed in which the piezoelectric material 41 is sandwiched between the common internal electrode 39 and the individual internal electrode 40 or the individual external electrode 43. Applying a potential difference to the internal electrodes 39 and 40 causes the piezoelectric material 41 of the active portion A to deform so that the free end portion 20*a* is displaced to expand or contract in the vibrator lengthwise direction. On the other hand, a layer at the end of the second side of the free end portion 20*a* is the piezoelectric material 41*s* and an electric field is not applied to this piezoelectric material 41*s*. Accordingly, this portion becomes an inactive portion B that is not displaced when the piezoelectric vibrator 20 is driven. In FIG. 4A, the inactive portion B in which both sides of the piezoelectric material 41 are not sandwiched between the common internal electrodes 39 and the individual internal electrode 40 or the individual external electrode 43 is indicated by hatching including the piezoelectric material 41*s*.

At the time of the piezoelectric vibrator 20 being driven, because the piezoelectric material 41*s* of the layer at the end of the second side, which is part of the inactive portion, limits the expansion and contraction of the piezoelectric vibrator 20, the displacement amount (absolute value) of the piezoelectric vibrator 20 being driven is relatively large at the first side, whereas the displacement amount becomes smaller as it progresses toward the second side (the piezoelectric material 41*s* side). The piezoelectric vibrator 20 of this configuration, in comparison with a piezoelectric vibrator of the existing configuration in which an external electrode is formed on the surface of the second side (the layer at the end of the second side is an external electrode), can have a relatively large amount of displacement at the first side like the existing piezoelectric vibrator; moreover, the displacement amount at the first side can be made larger than that at the second side with certainty, that is, it can be made large in a stable manner. Therefore, even if there exists a variation in the thickness of the piezoelectric layers, a magnitude relationship of the displacement amounts from the layer at the end of the second side toward the layer at the end of the first side, that is, a relationship that the displacement amount becomes larger as it progresses from the layer at the second side toward the layer at the first side, is always maintained between the individual piezoelectric vibrators and also between the end of the first side and the end of the second side of the identical piezoelectric vibrator, thereby making it possible to obtain a stable displacement-operation characteristic (displacement amount characteristic). In particular, a large amount of displacement can be obtained for sure (stably) at the first side opposite to the second side where the fixing plate is bonded. Accordingly, the volume of the pressure chamber 28 can be more efficiently changed by making use of the above characteristic appropriately. This point will be described in detail later.

A costly rare metal is used for the electrodes; however, as described above, no external electrode is formed on the surface of the second side of the piezoelectric vibrator 20 in the laminating direction. Accordingly, costs can be suppressed by the amount corresponding to a potential cost of the rare metal not being used. Further, there exists a risk of generation of a defect called a spot in the external electrode in the manufacturing process, or a risk of generation of a short circuit between the piezoelectric vibrators due to burrs or the like produced when the cut-and-divide processing is performed. However, because no external electrode is formed on the surface of the second side, it is possible to lower the risk of generation of the defect, and to enhance the yield.

The flow path unit 17 is configured so that the nozzle plate 24 is bonded to one surface of a flow path formation substrate 23 and the vibration plate 25 is bonded to the other surface of the flow path formation substrate 23. In the flow path unit 17, there are provided a reservoir 26 (common liquid chamber), an ink supply port 27, the pressure chamber 28, a nozzle communication port 29, and a nozzle 30. An ink flow path (liquid flow path) continuously extending from the ink supply port 27 to the nozzle 30 via the pressure chamber 28 and the nozzle communication port 29 is provided corresponding to each nozzle 30. The pressure chamber 28 is configured of a space elongated in a direction orthogonal to a nozzle row to be explained later, and the upper surface thereof (surface on the side where the vibration plate 25 is bonded) is opened. One end portion of the pressure chamber 28 in a lengthwise direction thereof communicates with the nozzle 30 via the nozzle communication port 29 penetrating through the flow path formation substrate 23 in a thickness direction, while the other end portion thereof in the lengthwise direction communicates with the reservoir 26 via the ink supply port 27. An upper side opening of the pressure chamber 28 is sealed by the vibration plate 25. Further, on the upper side opening of the pressure chamber 28 in a sealed state, there is disposed the diaphragm portion 33, details of which will be described later.

The nozzle plate 24 is a thin metallic plate (stainless steel, for example) in which a plurality of nozzles 30 are bored in a row at a pitch corresponding to a dot formation density (for example, 180 dpi). A plurality of nozzle rows (nozzle groups) including the aligned nozzles 30 are provided on the nozzle plate 24, and one nozzle row is configured of 180 nozzles 30, for example. The nozzle plate 24 is made of other material such as a silicon single crystal substrate or the like in some cases.

The vibration plate 25 has a two-tier structure in which a flexible film 32 is laminated on a surface of a support plate 31. In the present embodiment, the vibration plate 25 is configured with a composite board in which a resin film is laminated as the flexible film 32 on the surface of the support plate 31 that is made of a metal plate such as a stainless steel or the like. In the vibration plate 25, the diaphragm portion 33 configured to change the volume of the pressure chamber 28 is formed at a portion corresponding to each pressure chamber 28 of the liquid flow formation substrate 23. Further, in the vibration plate 25, a compliance portion 34 configured to seal the reservoir 26 is provided at a portion corresponding to the reservoir 26 of the flow path formation substrate 23. The compliance portion 34 is manufactured as follows: that is, the support plate 31 present in a region facing an opening surface of the reservoir 26 is removed by etching or the like so that only the flexible film 32 is present in this region. The compliance portion 34 functions as a damper for absorbing a pressure change in liquid stored in the reservoir 26.

Like the compliance portion 34, the diaphragm portion 33 is manufactured by partly removing the support plate 31 by etching. That is, the diaphragm portion 33 is configured of the island-shaped part 35 to which the leading end surface of the piezoelectric vibrator 20 is bonded and an elastic film portion 36 which is formed of only the flexible film 32 surrounding the circumference of the island-shaped part 35. The elastic film portion 36 is a portion where the support plate 31 is removed across a formation range of the pressure chamber 28 while the support plate 31 serving as the island-shaped part 35 is left. Of the diaphragm portion 33, a portion that seals the upper side opening of the pressure chamber 28 and is actually displaced in accordance with the expansion and contraction of the piezoelectric vibrator 20 (a portion including the island-shaped part 35 and the elastic film portion 36 present in the circumference of the island-shaped part 35), corresponds to an effective displacement portion. When the dimension of the effective displacement portion in the laminating direction of the piezoelectric material and electrodes (hereinafter, simply called the "laminating direction") is taken as L1, the dimension of the island-shaped part 35 in the same direction is taken as L2, a relation of $L2/L1 \geq 0.85$ is being set (note that L2/L1 is less than 1). With this, the displacement of the piezoelectric vibrator 20 can be efficiently converted to a change in volume of the pressure chamber 28. The island-shaped part 35 is disposed at a position on the opposite side to the pressure chamber 28 sandwiching the elastic film portion 36 of the effective displacement portion therebetween. The piezoelectric vibrator 20 can displace the diaphragm portion 33, that is, displace the effective displacement portion via the island-shaped part 35.

In FIG. 4B, a portion that corresponds to the elastic film portion 36 of the diaphragm portion 33 is indicated by a whitened rectangle shape. However, the effective displacement portion is not necessarily a region having a rectangle shape when viewed from above because the effective displacement portion is determined in accordance with a shape of the opening of the pressure chamber 28; for example, if the shape of the opening of the pressure chamber is a parallelogram, the effective displacement portion becomes a parallelogram-shaped region following the shape of the opening. In FIG. 4B, the center of the effective displacement portion (center in the laminating direction) is taken as C1. Likewise, the center of the piezoelectric vibrator 20 (center in the laminating direction) is taken as C2.

The recording head 2 of the present embodiment is characterized in that the leading end surface of the piezoelectric vibrator 20 is bonded to the island-shaped part 35 in a state in which the piezoelectric vibrator 20 is off-center with respect to the diaphragm portion 33 (effective displacement portion). To be more specific, with respect to the center C1 of the effective displacement portion, the center C2 of the piezoelectric vibrator 20 is disposed off-center toward the second side in the laminating direction, in other words, off-center toward the side of the piezoelectric material 41*s* which is a layer at the side end and is the inactive portion B. On the other hand, the center of the island-shaped part 35 in the laminating direction substantially matches the center C1 of the effective displacement portion. That is to say, the island-shaped part 35 is disposed at a center portion of the effective displacement portion. With this, in a state in which the leading end surface of the piezoelectric vibrator 20 is bonded to the island-shaped part 35, the length of an extending portion of the island-shaped part 35 extended to both sides in the laminating direction from a bonding portion of the island-shaped part 35 and the piezoelectric vibrator 20 is longer at the first side than at the second side. In other words, if the length of the extending portion on the first side (nozzle communication port 29 side) is taken as L3 and the length of the extending portion on the second side (ink supply port 27 side) is taken as L4, a relation of L3>L4 holds. As described above, by making the piezoelectric vibrator 20 off-center toward the second side in the laminating direction with respect to the effective displacement portion, a portion of the free end portion 20*a* at the first side whose displacement amount is relatively large is disposed closer to the center C1 of the effective displacement portion; accordingly, it is possible to displace the regions on both sides from the center C1 of the effective displacement portion in the laminating direction as equally as possible when the piezoelectric vibrator 20 is driven. In other words, a volume of the pressure chamber 28 that has been changed to due to the displacement of the effective displacement portion on the first side from the center C1 of the effective displacement portion in the laminating direction and a volume of the pressure chamber 28 that has been changed to due to the displacement of the effective displacement portion on the second side from the center C1 in the laminating direction, are substantially equivalent to each other when the piezoelectric vibrator 20 is driven.

In the case where the center C1 of the effective displacement portion and the center C2 of the piezoelectric vibrator C2 are made to match each other, the displacement of the region on the first side from the center C1 of the effective displacement portion becomes relatively large, whereas the displacement on the second side from the center C1 of the effective displacement portion becomes relatively small. In contrast, by making the piezoelectric vibrator 20 off-center toward the second side in the laminating direction with respect to the effective displacement portion, the displacement of the region on the second side from the center C1 of the effective displacement portion can be larger than that of the above case, whereby the displacement on both sides from the center C1 of the effective displacement portion can be made uniform. That is, the amounts of changes in volume of the pressure chamber 28 generated on both sides from the center C1 due to the above-mentioned displacement can be made uniform. That is, the degrees of pressure changes generated in the ink within the pressure chamber 28 on both sides from the center C1 can be made equivalent to each other. As a result, while reducing problems such as variation in the ink amount ejected through the nozzle 30, variation in the flying direction of the ink, and the like caused by deflection in the displacement of the piezoelectric vibrator 20, it is possible to effectively make use of such an advantage of the piezoelectric vibrator that an absolute displacement amount is large when a predetermined potential is applied, whereby the volume of the pressure chamber 28 can be changed efficiently and stably.

As shown in FIG. 4B, in the present embodiment, a width W1 of the island-shaped part 25 on the second side (dimension in a direction orthogonal to the laminating direction) in a lengthwise direction of the island-shaped part 25 (laminating direction of the piezoelectric vibrator 20) is wider than a width W2 on the first side in the same direction thereof. To be more specific, in a state of the piezoelectric vibrator 20 being bonded, a portion on the second side from the center C2 of the piezoelectric vibrator in the laminating direction corresponds to a wide-width portion 35*w* whose width is wider than that of other portion (a narrow-width portion 35*n*). The width W1 of the wide-width portion 35*w* is set narrower than the width of the effective displacement portion.

In a state in which the piezoelectric vibrator 20 is positioned with respect to the island-shaped part 35 (positioned off-center with respect to the effective displacement portion, as described above), a portion of the piezoelectric vibrator 20 (free end portion 20*a*) on the first side whose displacement amount is relatively large is disposed at the narrow-width portion 35*n* of the island-shaped part 35, while the inactive portion B (piezoelectric material 41*s*) of the piezoelectric vibrator 20 on the second side whose displacement amount is relatively small is disposed at the wide-width portion 35*w* of the island-shaped part 35. Since the wide-width portion 35*w* displaces a wider range of the elastic film portion 36 than the narrow-width portion 35*n*, it is possible to further match the respective displacement amounts of the regions on both sides from the center C1 of the effective displacement portion when the piezoelectric vibrator 20 is driven. Consequently, the volume of the pressure chamber 28 can be changed further efficiently and stably.

Figure 5:
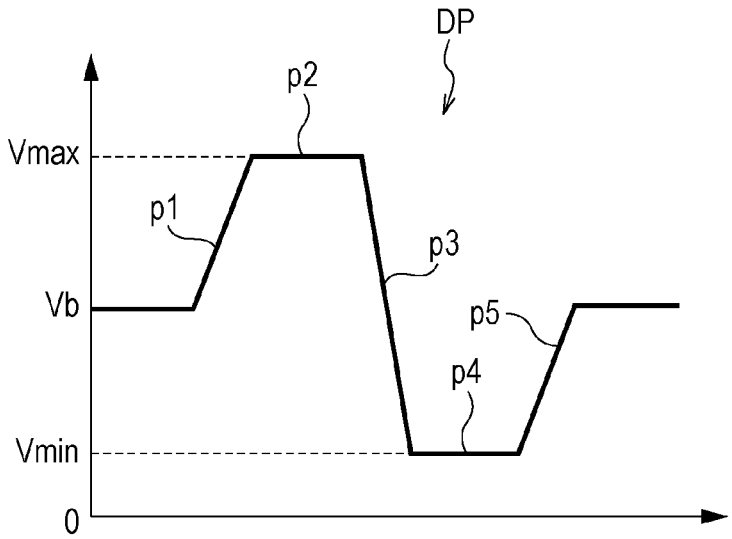
FIG. 5 is a waveform diagram of an ejection driving pulse.

FIG. 5 is a waveform diagram illustrating an example of a configuration of the ejection driving pulse DP for driving the piezoelectric vibrator 20 so as to eject ink through the nozzle 30. In FIG. 5, the vertical axis represents a potential and the horizontal axis represents time. The ejection driving pulse DP includes an expansion element p1 in which the potential changes toward a potential increasing side from a base potential (intermediate potential) Vb up to a maximum potential (maximum voltage) Vmax so as to expand the pressure chamber 28, an expansion holding element p2 for holding the maximum potential Vmax for a set period of time, a contraction element p3 in which the potential changes toward a potential decreasing side from the maximum potential Vmax down to a minimum potential (minimum voltage) Vmin so as to rapidly contract the pressure chamber 28, a contraction holding (vibration-suppression holding) element p4 for holding the minimum potential Vmin for a set period of time, and a return element p5 in which the potential returns to the base potential Vb from the minimum potential Vmin.

Figure 6A:
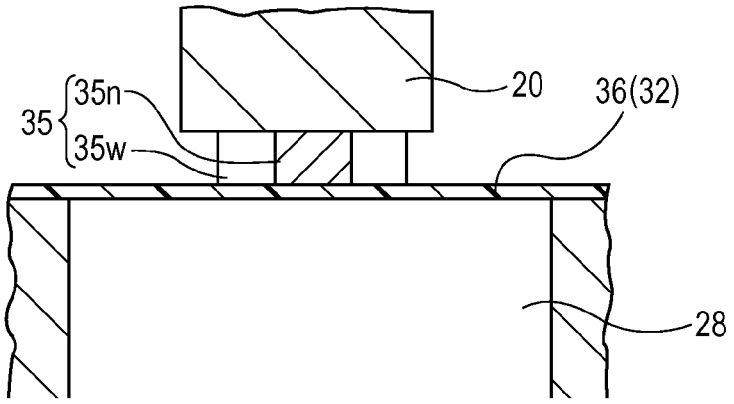
FIG. 6A through FIG. 6C are cross-sectional views of a pressure chamber in a short-length direction thereof showing movement of a diaphragm portion at a time of ink ejection.
Figure 6B:
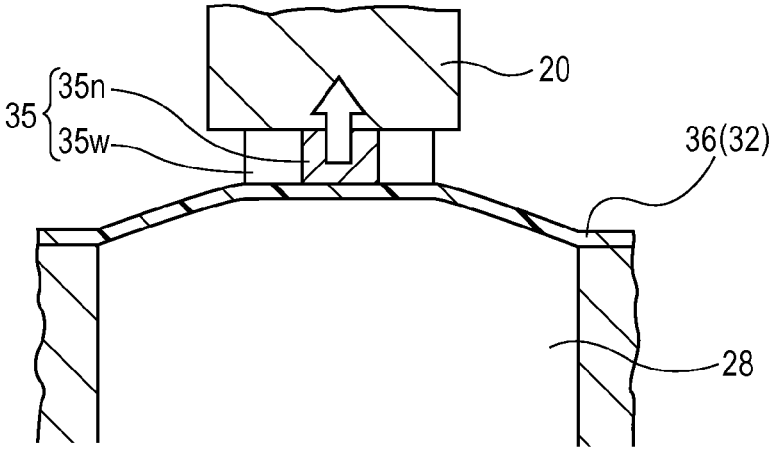
Figure 6C:
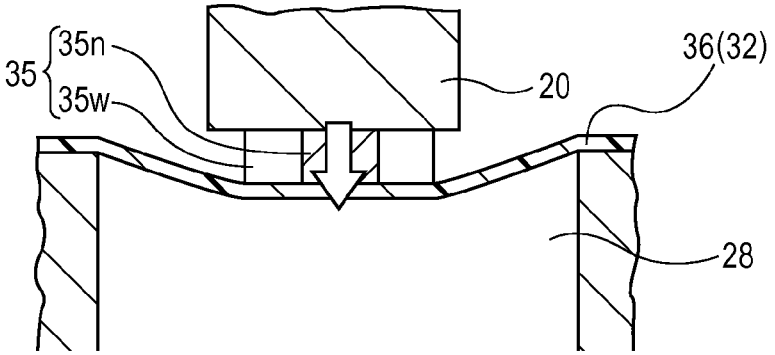
Figure 7A:
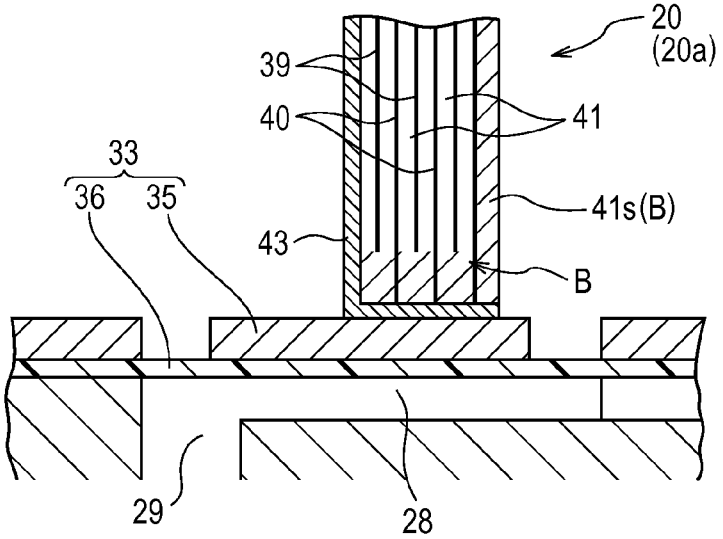
FIG. 7A through FIG. 7C are cross-sectional views of a pressure chamber in a lengthwise direction thereof showing movement of a diaphragm portion at a time of ink ejection.
Figure 7B:
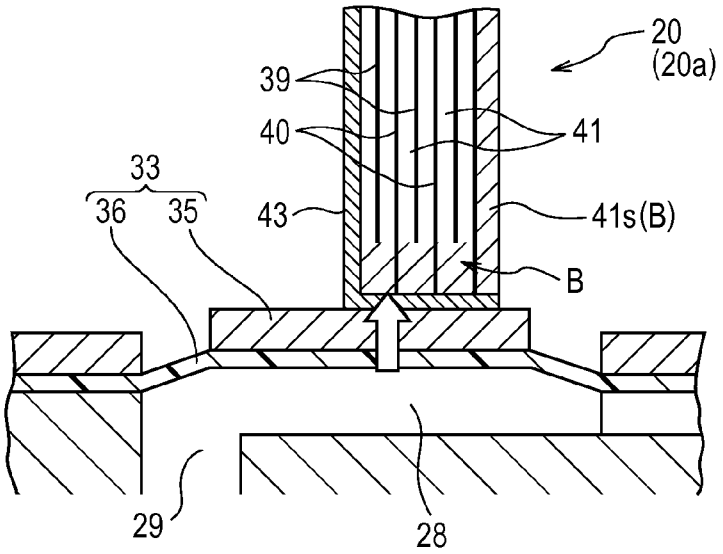
Figure 7C:
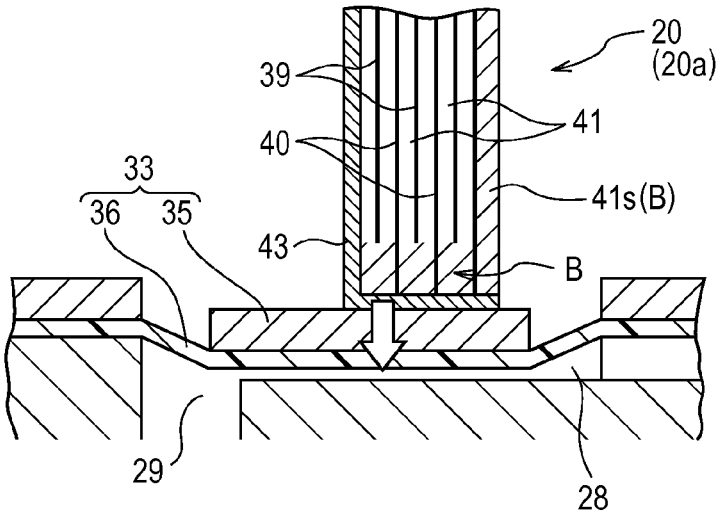

FIG. 6A through FIG. 6C are cross-sectional views of the pressure chamber 28 in a short-length direction thereof (a direction orthogonal to the laminating direction) for describing the movement of the diaphragm portion 33 (effective displacement portion) at a time when ink is ejected through the nozzle 30 by driving the piezoelectric vibrator 20. FIG. 7A through FIG. 7C are cross-sectional views of the pressure chamber 28 in the lengthwise direction thereof (laminating direction) for describing the movement of the diaphragm portion 33 (effective displacement portion) at the time when ink is similarly ejected.

The ejection driving signal DP makes the following action take place when it is applied to the piezoelectric vibrator 20. In the case where the potential applied to the piezoelectric vibrator 20 is at the base potential Vb, which is a start potential and also an end potential of the ejection driving pulse DP, the island-shaped part 35 is positioned in the vicinity of the opening portion of the pressure chamber 28 as shown in FIG. 6A and FIG. 7A. When the ejection driving pulse DP is applied to the piezoelectric vibrator 20, the piezoelectric vibrator 20 is made to contract in a direction orthogonal to the laminating direction by the expansion element p1. Since the circumference of the island-shaped part 35 (within the effective displacement portion) is occupied by the elastic film portion 36, deformation of this elastic film portion 36 allows the displacement of the island-shaped part 35 (displacement of the effective displacement portion) following the contraction of the piezoelectric vibrator 20. That is, as shown in FIG. 6B and FIG. 7B, when the piezoelectric vibrator 20 contracts, the island-shaped part 35 is displaced toward a side apart from the pressure chamber 28 (opposite side to the nozzle plate 24) following the contraction of the vibrator. In this case, because the piezoelectric vibrator 20 is disposed off-center toward the other side with respect to the effective displacement portion, variations in the displacement amounts of the piezoelectric vibrator 20 in the laminating direction are cancelled out, thereby making it possible to displace the effective displacement portion as uniformly as possible. Due to this displacement, the pressure chamber 28 is made to expand from a base volume corresponding to the base potential Vb to a maximum volume corresponding to the maximum potential Vmax. The expansion of the pressure chamber 28 causes a meniscus exposed in the nozzle 30 to be pulled in toward the pressure chamber side.

The expansion state of the pressure chamber 28 is held constant for a period of time during which the expansion holding element p2 is applied. During the above period of time, since the piezoelectric vibrator 20 holds the contraction state thereof, the island-shaped part 35 holds its position as well. When the contraction element p3, following the expansion holding element p2, is applied to the piezoelectric vibrator 20, the piezoelectric vibrator 20 is made to expand to the maximum or approximately to the maximum. Also in this case, because the piezoelectric vibrator 20 is disposed off-center toward the second side with respect to the effective displacement portion, it is possible to displace the effective displacement portion as uniformly as possible. With this, as shown in FIG. 6C and FIG. 7C, the island-shaped part 35 is rapidly displaced toward a side approaching the pressure chamber 28 (nozzle plate 24 side). This causes the pressure chamber 28 to contract rapidly from the above-mentioned maximum volume to a minimum volume corresponding to the minimum potential Vmin. The rapid contraction of the pressure chamber 28 pressurizes ink in the pressure chamber 28 so that several p1 (picoliters) to several tens of p1 of ink is ejected through the nozzle 30. The contraction state of the pressure chamber 28 is held for a short period of time during which the contraction holding element p4 is applied. During the above period of time, since the piezoelectric vibrator 20 holds the expansion state thereof, the island-shaped part 35 holds its position as well. Thereafter, the return element p5 is applied to the piezoelectric vibrator 20 so that the piezoelectric vibrator 20 is made to contract. Following the contraction, the island-shaped part 35 is displaced to a stationary position corresponding to the base potential Vb. This causes the pressure chamber 28 to return to the base volume.

As described thus far, the recording head 2 employs the piezoelectric vibrator 20 of the configuration in which an external electrode is formed on a layer at the end of the first side of the laminate structure in the laminating direction while no electrode is formed on a layer at the end of the second side of the laminate structure in the same direction. Accordingly, in comparison with the existing configuration in which electrodes are formed on layers on both the side ends, it is possible to obtain a relatively large displacement amount on the first side like in the existing configuration, and it is also possible to make the displacement amount on the first side be larger with certainty than the displacement amount on the second side, that is, it is possible to make the displacement amount on the first side be stably large. In order to appropriately make use of the characteristics and advantages of the piezoelectric vibrator 20, the piezoelectric vibrator 20 is disposed being off-center toward the side of the piezoelectric material 41*s* as the inactive portion B (toward the second side) with respect to the effective displacement portion of the diaphragm portion 33, so that the regions on both sides from the center C1 of the effective displacement portion in the laminating direction can be displaced as equally as possible when the piezoelectric vibrator 20 is driven. This makes it possible to efficiently convert the expansion and contraction of the piezoelectric vibrator 20 to the change in volume of the pressure chamber 28. As a result, while reducing the problems such as variation in the ink amount ejected through the nozzle 30, variation in the flying direction of the ink, and the like caused by deflection in the displacement of the piezoelectric vibrator 20, it is possible to effectively make use of such an advantage of the piezoelectric vibrator 20 that an absolute displacement amount is large when a predetermined potential is applied, whereby the volume of the pressure chamber 28 can be changed efficiently and stably.

In addition, the discharge characteristic and the displacement amount can be enhanced in the printer 1 having the recording head 2.

Note that the present invention is not intended to be limited to the above embodiment, and various kinds of variations can be made.

Figure 8A:
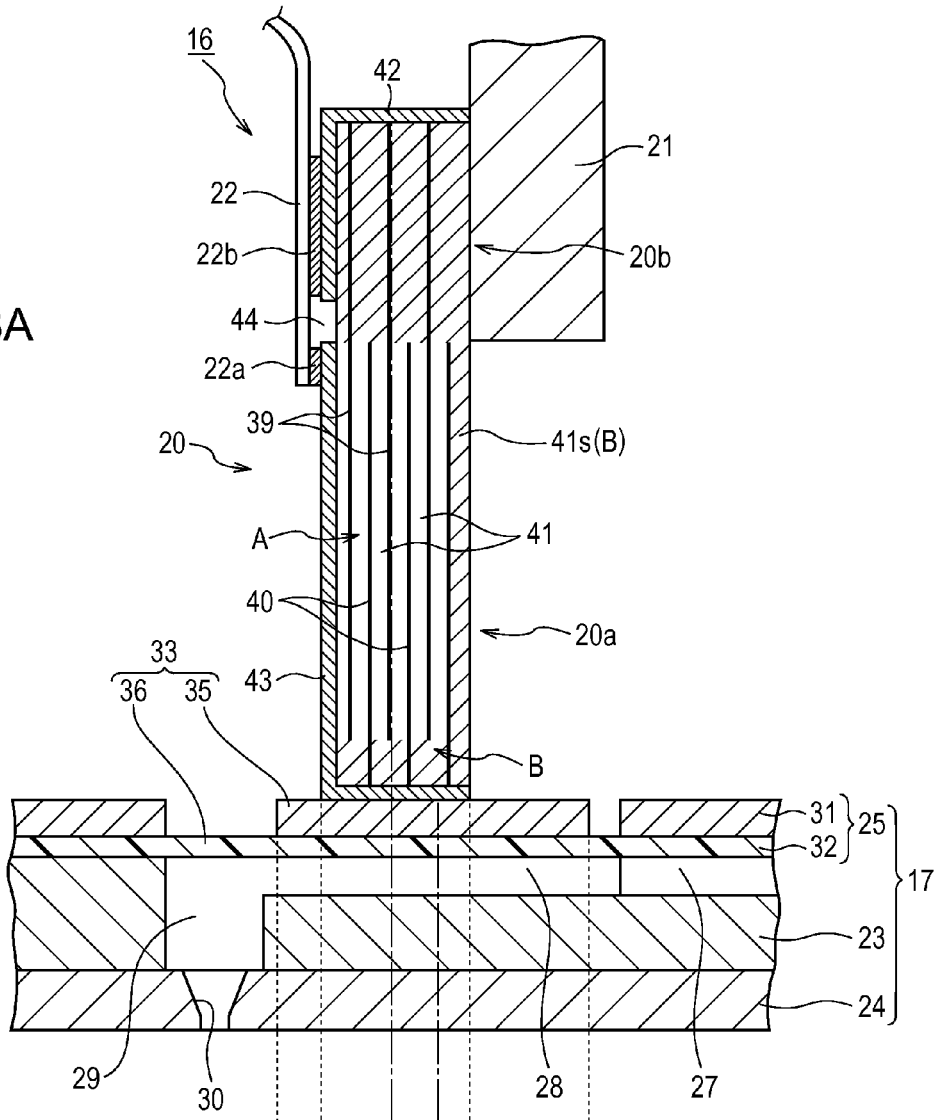
FIGS. 8A and 8B are views of the periphery of a vibrator unit according to a second embodiment.
Figure 8B:
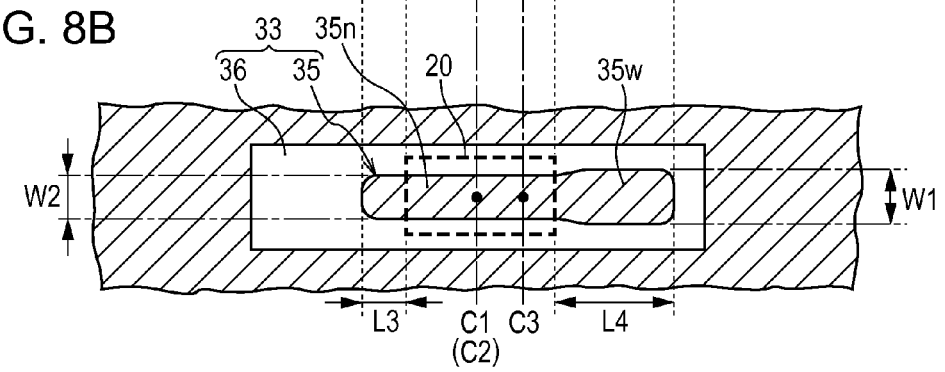

FIGS. 8A and 8B are views of the periphery of a vibrator unit 16 according to a second embodiment. Although the configuration in which the leading end surface of the piezoelectric vibrator 20 is bonded to the island-shaped part 35 while the piezoelectric vibrator 20 being off-center with respect to the effective displacement portion of the diaphragm portion 33 is exemplified in the first embodiment, the invention is not limited thereto. The recording head 2 of the present embodiment is characterized in that the island-shaped part 35 is disposed being off-center with respect to the effective displacement portion of the diaphragm portion 33. More specifically, a center C3 of the island-shaped part 35 in the laminating direction is disposed being off-center, not toward one side (hereinafter referred to as a third side; corresponding to the first side in the first embodiment) but towards the other side (hereinafter referred to as a fourth side; corresponding to the second side in the first embodiment) in the laminating direction, that is, off-center toward the piezoelectric material 41*s* side (the ink supply port 27 side) with respect to the center C1 of the effective displacement portion in the laminating direction; note that the piezoelectric material 41*s* is a layer at the side end, and is the inactive portion B of the piezoelectric vibrator 20. The center C2 of the piezoelectric vibrator 20 in the laminating direction is disposed in a state in which the center C2 substantially matches the center C1 of the effective displacement portion. Accordingly, in a state in which the leading end surface of the piezoelectric vibrator 20 is bonded to the island-shaped part 35, the length of an extending portion of the island-shaped part 35 extended to both sides in the laminating direction from the bonding portion of the island-shaped part 35 and the piezoelectric vibrator 20 is longer at the fourth side than at the third side. That is, as for the length L3 of the extending portion on the third side and the length L4 of the extending portion on the fourth side, a relation of L3<L4 holds. Further, also in the present embodiment, the width W1 of the island-shaped part 25 on the fourth side (dimension in a direction orthogonal to the laminating direction) in the lengthwise direction of the island-shaped part 25 (laminating direction of the piezoelectric vibrator 20) is wider than the width W2 on the third side in the same direction thereof.

As is described in the present embodiment, by making the island-shaped part 35 be off-center toward the fourth side in the laminating direction with respect to the effective displacement portion, an area of the island-shaped part 35 disposed on the fourth side from the center C1 of the effective displacement portion in the laminating direction is wider than an area of the island-shaped part 35 disposed on the third side from the center C1 thereof. This makes it possible to make the displacement amounts of the regions on both sides from the center C1 of the effective displacement portion in the laminating direction be uniform when the piezoelectric vibrator 20 is driven. As a result, while reducing the problems such as variation in the amount of ink ejected through the nozzle 30, variation in the flying direction of the ink, and the like caused by deflection in the displacement of the piezoelectric vibrator 20, it is possible to change the volume of the pressure chamber 28 efficiently and stable through making use of an advantage of the piezoelectric vibrator 20 that the displacement amount thereof can be made larger. Since other configurations of the present embodiment are the same as those of the first embodiment, detailed description thereof will be omitted herein.

In the above embodiments, regarding the shape of the island-shaped part 35, the configuration in which the island-shaped part 35 is shaped so that the width W1 of the island-shaped part 35 on the fourth side in the laminating direction is wider than the width W2 on the third side in the same direction is exemplified. However, the shape is not limited thereto, and the island-shaped part 35 whose widths on the third side and the fourth side are constant can be employed. Also in this case, by employing a configuration in which the piezoelectric vibrator 20 or the island-shaped part 35 is disposed being off-center with respect to the effective displacement portion, it is possible to make the displacement amounts of the regions on both sides from the center C1 of the effective displacement portion in the laminating direction be uniform.

Figure 9:
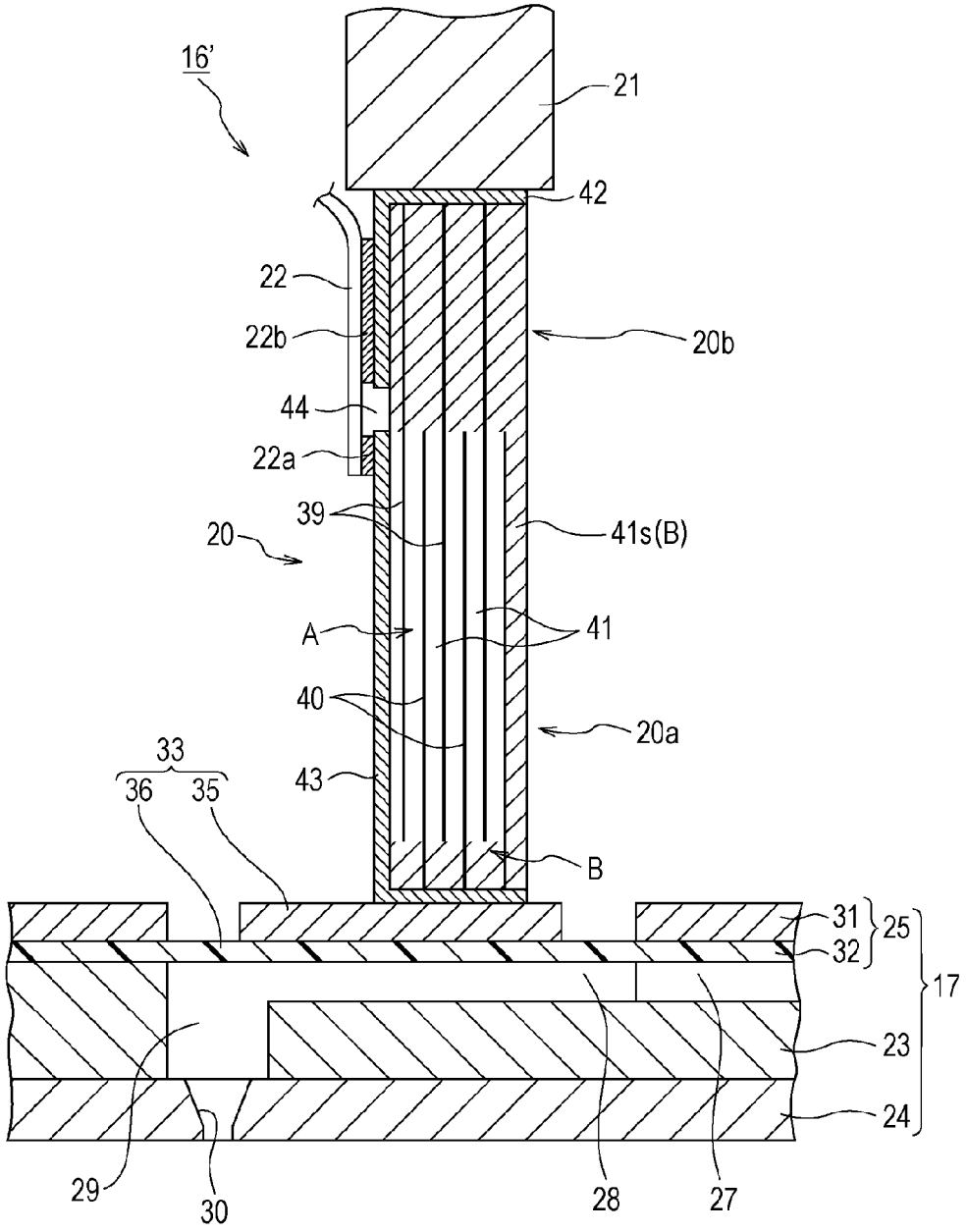
FIG. 9 is a cross-sectional view of a vibrator unit.

Regarding the configuration of the vibrator unit 16, the configuration in which the fixing plate 21 is bonded to the fourth side surface of the piezoelectric vibrator 20 (in other words, the piezoelectric material 41*s*) at the base end portion 20*b* side is exemplified; however, the configuration thereof is not limited thereto. For example, the present invention can be applied to a configuration in which the fixing plate 21 is bonded to the base end surface of the piezoelectric vibrator 20 (surface on the opposite side to the leading end surface to be bonded to the island-shaped part 35) like the configuration of a vibrator unit 16' as a variation shown in FIG. 9. Further, the present invention can be also applied to a configuration in which the fixing plate 21 is bonded to the surface of the third side of the piezoelectric vibrator 20 (surface on the side where the external electrode is formed).

Thus far, the ink jet recording head 2, which is a type of a liquid ejecting head, has been exemplified and explained. The present invention can be applied to other liquid ejecting heads configured to eject liquids through nozzles by displacing island-shaped parts using piezoelectric vibrators to change a volume of the pressure chambers. For example, the present invention can be applied to coloring material ejecting heads mounted on display manufacturing apparatuses for the manufacture of color filters of liquid crystal displays or the like, electrode material ejecting heads mounted on electrode manufacturing apparatuses for the formation of electrodes of organic EL (electroluminescence) displays, surface emitting displays (FEDs) or the like.

What is claimed is:

1. A liquid ejecting head, comprising:

a pressure chamber communicating with a nozzle, the pressure chamber extending in a first direction;

a vibration plate defining part of the pressure chamber, the vibrating plate having an effective displacement portion overlapping with the pressure chamber in a plan view; and a piezoelectric vibrator being provided above the effective displacement portion so as to displace the effective displacement portion of the vibration plate, wherein the piezoelectric vibrator has a laminate structure in which electrodes and piezoelectric material are alternately laminated in the first direction, a first outermost layer at one side of the laminate structure in the first direction is an electrode, a second outermost layer at the other side of the laminate structure in the first direction is a piezoelectric layer, a side of the laminate structure of the piezoelectric vibrator is located above the effective displacement portion of the vibration plate, and the side of the piezoelectric vibrator is laterally offset toward the other side in the first direction with respect to a center of the effective displacement portion in the first direction.

2. The liquid ejecting head according to claim 1, wherein the vibration plate includes an island-shaped part which is provided in the effective displacement portion, the island-shaped part is on an opposite side of the effective displacement portion as the pressure chamber, and the island-shaped part is bonded to the side of the piezoelectric vibrator, the island-shaped part is located on the center of the effective displacement portion in the first direction, and a first length in the first direction between a first edge of the island-shaped part and a surface of the first outermost layer is longer than a second length in the first direction between a second edge of the island-shaped part and a surface of the second outermost layer.

3. The liquid ejecting head according to claim 2, wherein a first width of the first edge in a second direction intersecting with the first direction is narrower than a second width of the second edge in the second direction.

4. The liquid ejecting head according to claim 1, wherein a ratio of a dimension of the island-shaped part to a dimension of the effective displacement portion in the first direction is equal to or more than 0.85.

5. The liquid ejecting head according to claim 1, wherein a fixing plate is bonded to the piezoelectric vibrator at a position opposite to a bonding interface where the island-shaped part is bonded with the piezoelectric vibrator.

6. A liquid ejecting head, comprising:

a pressure chamber communicating with a nozzle, the pressure chamber extending in a first direction;

a vibration plate defining part of the pressure chamber, the vibrating plate having an effective displacement portion overlapping with the pressure chamber in a plan view;

a piezoelectric vibrator being provided above the effective displacement portion so as to displace the effective displacement portion of the vibration plate;

an island-shaped part provided in the effective displacement portion, the island-shaped part being on an opposite side of the effective displacement portion as the pressure chamber, wherein the piezoelectric vibrator has a laminate structure in which electrodes and piezoelectric material are alternately laminated in the first direction, a first outermost layer at one side of the laminate structure in the first direction is an electrode, a second outermost layer at the other side of the laminate structure in the first direction is a piezoelectric layer, a side of the laminate structure of the piezoelectric vibrator is located above the effective displacement portion of the vibration plate, the island-shaped part is bonded to the side of the piezoelectric vibrator, and the island-shaped part is laterally offset toward the other side in the first direction with respect to a center of the effective displacement portion in the first direction.

7. The liquid ejecting head according to claim 6, wherein the piezoelectric vibrator is located on the center of the effective displacement portion in the first direction, and a first length in the first direction between a first edge of the island-shaped part and a surface of the first outermost layer is shorter than a second length in the first direction between a second edge of the island-shaped part and a surface of the second outermost layer.

8. A liquid ejecting apparatus comprising the liquid ejecting head according to claim 1.

9. A liquid ejecting apparatus comprising the liquid ejecting head according to claim 2.

10. A liquid ejecting apparatus comprising the liquid ejecting head according to claim 3.

11. A liquid ejecting apparatus comprising the liquid ejecting head according to claim 4.

12. A liquid ejecting apparatus comprising the liquid ejecting head according to claim 5.

13. A liquid ejecting apparatus comprising the liquid ejecting head according to claim 6.

14. A liquid ejecting apparatus comprising the liquid ejecting head according to claim 7.

15. A liquid ejecting head, comprising:

a pressure chamber communicating with a nozzle, the pressure chamber extending in a first direction;

a vibration plate defining a wall of the pressure chamber, the vibrating plate having a movable part overlapping with the pressure chamber in a plan view; and a piezoelectric vibrator being provided above the movable part so as to move the movable part of the vibration plate, the piezoelectric vibrator being a laminate structure in which electrodes and piezoelectric material are laminated, the piezoelectric vibrator having first and second outermost layers in the first direction, wherein the first outermost layer at one side of the laminate structure in the first direction is an electrode, and the second outermost layer at the other side of the laminate structure in the first direction is a piezoelectric layer, a side of the laminate structure of the piezoelectric vibrator is located above the movable part of the vibration plate, and the side of the piezoelectric vibrator is laterally offset toward the other side in the first direction with respect to a center of the movable part in the first direction.

16. The liquid ejecting head according to claim 15, wherein the vibration plate includes an island-shaped member in the movable part, and the island-shaped member is bonded to the side of the piezoelectric vibrator, a center of the island-shaped part in the first direction is located on the center of the movable part in the first direction, and the side of the piezoelectric vibrator is laterally offset relative to the center of the island-shaped member in the first direction.

* * * * *